US007338261B2

(12) United States Patent
Kawahara et al.

(10) Patent No.: US 7,338,261 B2
(45) Date of Patent: Mar. 4, 2008

(54) HYBRID COMPRESSOR

(75) Inventors: Takayuki Kawahara, Isesaki (JP); Hiromitsu Adachi, Wako (JP); Shinichirou Wakou, Wako (JP); Hideki Watanabe, Wako (JP)

(73) Assignees: Honda Motor Co., Ltd., Tokyo (JP); Sanden Corporation, Gunma (JP)

( * ) Notice: Subject to any disclaimer, the term of this patent is extended or adjusted under 35 U.S.C. 154(b) by 758 days.

(21) Appl. No.: 10/797,567

(22) Filed: Mar. 11, 2004

(65) Prior Publication Data

US 2004/0265143 A1 Dec. 30, 2004

(30) Foreign Application Priority Data

Mar. 14, 2003 (JP) ..... 2003-069841

(51) Int. Cl.
*F04B 9/14* (2006.01)

(52) U.S. Cl. ..... 417/374

(58) Field of Classification Search ..... 417/2, 417/3, 16, 223, 374
See application file for complete search history.

(56) References Cited

U.S. PATENT DOCUMENTS

| | | | | |
|---|---|---|---|---|
| 4,591,318 | A | 5/1986 | Elson | |
| 4,990,071 | A | 2/1991 | Sugimoto | |
| 5,295,808 | A * | 3/1994 | Machida et al. | 417/366 |
| 5,385,453 | A | 1/1995 | Fogt et al. | |
| 5,435,144 | A | 7/1995 | Kalmbach | |
| 5,755,564 | A | 5/1998 | Machida et al. | |
| 5,867,996 | A | 2/1999 | Takano et al. | |
| 5,983,656 | A | 11/1999 | Tokumasu | |
| 6,109,045 | A | 8/2000 | Takenaka | |
| 6,192,155 | B1 | 2/2001 | Fan | |
| 6,217,297 | B1 | 4/2001 | Tsumagari et al. | |
| 6,230,507 | B1 | 5/2001 | Ban et al. | |
| 6,234,769 | B1 | 5/2001 | Sakai et al. | |
| 6,247,899 | B1 | 6/2001 | Ban et al. | |
| 6,287,081 | B1 | 9/2001 | Tamegai et al. | |
| 6,334,755 | B1 | 1/2002 | Coudray et al. | |
| 6,375,436 | B1 | 4/2002 | Irie et al. | |
| 6,443,712 | B2 | 9/2002 | Sakai et al. | |
| 6,543,243 | B2 | 4/2003 | Mohrmann et al. | |

(Continued)

FOREIGN PATENT DOCUMENTS

| | | |
|---|---|---|
| DE | 19513710 | 10/1995 |

(Continued)

*Primary Examiner*—Charles G Freay
(74) *Attorney, Agent, or Firm*—Baker Botts, LLP

(57) ABSTRACT

A hybrid compressor includes a first compression mechanism, which is driven by a first drive source, and a second compression mechanism, which is driven by a second drive source, and a second radial axis of a second housing of the second compression mechanism is offset relative to a first radial axis of a first housing of the first compression mechanism, or a second diameter of the second housing of the second compression mechanism is less than a first diameter of the first housing of the first compression mechanism, or both. When a significant external force is applied to the front end of a vehicle containing the compressor, most of the external force may be absorbed by the first compression mechanism portion of the compressor, thereby reducing or avoiding damage to the second compression mechanism. In particular, when the second drive source is an incorporated electric motor, damage to the electric motor may be reduced or avoided.

16 Claims, 3 Drawing Sheets

U.S. PATENT DOCUMENTS

| | | | |
|---|---|---|---|
| 2001/0047659 | A1 | 12/2001 | Nakamura et al. |
| 2001/0049943 | A1 | 12/2001 | Nakamura et al. |
| 2003/0053916 | A1 | 3/2003 | Terauchi |
| 2003/0136138 | A1 | 7/2003 | Tsuboi et al. |
| 2003/0152467 | A1 | 8/2003 | Higashiyama et al. |
| 2004/0000156 | A1 | 1/2004 | Inoue et al. |
| 2004/0001760 | A1 | 1/2004 | Yoshii et al. |
| 2004/0020229 | A1 | 2/2004 | Adachi et al. |
| 2004/0211197 | A1 | 10/2004 | Higashiyama et al. |

FOREIGN PATENT DOCUMENTS

| | | |
|---|---|---|
| EP | 1213166 | 6/2002 |
| JP | 687678 | 12/1984 |
| JP | 60153885 | 10/1985 |

* cited by examiner

HYBRID COMPRESSOR

BACKGROUND OF THE INVENTION

1. Field of the Invention

The present invention relates to a hybrid compressor having two compression mechanisms capable of being driven independently by drive sources separate from each other.

2. Description of Related Art

A hybrid compressor capable of being driven by an internal combustion engine of a vehicle or an electric motor, or both, is described in Japanese Utility Model (Laid-Open) No. 6-87678. Such a hybrid compressor includes two compression mechanisms: a first compression mechanism driven by an engine or an electric motor for driving a vehicle and a second compression mechanism driven by an electric motor exclusively used for driving the second compression mechanism (for example, an electric motor incorporated into the compressor).

Further, a hybrid compressor used in a refrigeration cycle for an air conditioning system for vehicles, which has a first scroll-type compression mechanism driven exclusively by the drive source for driving a vehicle and a second scroll-type compression mechanism driven exclusively by an incorporated electric motor and in which the fixed scrolls of the first and second compression mechanisms are disposed back-to-back, e.g., extend in opposite directions from a common or shared valve plate, and assembled integrally with each other, is described in Japanese Patent Publication No. JP-A-2003-232281. In such a hybrid compressor, each compression mechanism may be driven independently and both compression mechanisms may be driven simultaneously, and an optimum discharge performance of the compressor may be obtained depending on the requirements at the present time.

In the known hybrid compressors described above, the first compression mechanism driven by a drive source for driving a vehicle and the second compression mechanism driven by an incorporated electric motor usually are disposed coaxially. Therefore, for example, in a situation in which the compressor is mounted on a vehicle, so that the first and the second compression mechanisms are a substantially equal distance from a front end of the vehicle. When an impact force is applied to the front end of the vehicle in an accident or the like, the same-degree of force may be applied to each of the first and second compression mechanisms, and both compression mechanisms may be damaged similarly.

However, because a high voltage usually is applied to the incorporated electric motor, if the second compression mechanism portion of the compressor, particularly, the electric motor portion, is damaged, not only mechanical damage, but also current leakage may occur.

SUMMARY OF THE INVENTION

Thus, a need has arisen for a hybrid compressor, which may reduce or avoid mechanical and electrical damage, due to front end accident. Accordingly, it is an object to provide a structure for a hybrid compressor having a first compression mechanism driven by a first drive source and a second compression mechanism driven by a second drive source, which reduces or avoids damage to the second compression mechanism, particularly, damage to an electric motor portion of the compressor, even when a significant external force is applied to the compressor. Thus, the occurrence of additional damage, such as current leakage, may be reduced or avoided.

To achieve the foregoing and other objects, a hybrid compressor according to an embodiment of the present invention is provided. The hybrid compressor comprises a first compression mechanism, which is driven by a first drive source, and a second compression mechanism, which is driven by a second drive source, and a second radial axis of a second housing of the second compression mechanism is offset relative to a first radial axis of a first housing of the first compression mechanism. In particular, in this hybrid compressor, consideration was given to a structure capable of driving and controlling each of the two compression mechanisms independently by one of the respective drive sources. The drive axes of the respective compression mechanisms may be shifted from each be other, and the radial axes of the housings of the compression mechanisms are offset intentionally from each other.

In this hybrid compressor, the first compression mechanism may be driven exclusively by a drive source for driving a vehicle. The drive source for driving a vehicle may include an internal combustion engine and an electric motor for driving an electric motor car or a hybrid car. Further, the second compression mechanism may be driven by an electric motor, e.g., an electric motor incorporated into the compressor.

In particular, when the hybrid compressor is mounted on a vehicle, an offset direction of the second radial axis of the second housing of the second compression mechanism relative to the first radial axis of the first housing of the first compression mechanism is away from the front end of the vehicle. This offset in a direction away from the front end of a vehicle may be in a horizontal direction, or may be an offset in another direction different from the horizontal direction, but also away from the vehicle's front end.

With respect to this hybrid compressor, the compressor may be configured, such that the first and second compression mechanisms are scroll-type compression mechanisms, and the fixed scrolls of each compression mechanism is disposed back-to-back, e.g., extend in opposite directions from a common valve plate.

In another embodiment of the present invention, the hybrid compressor comprises a first compression mechanism, which is driven by a first drive source, and a second compression mechanism, which is driven by a second drive source, and a second diameter of a second housing of the second compression mechanism is less than a first diameter of a first housing of the first compression mechanism. In particular, in this hybrid compressor, a predetermined size difference is established between the diameters of the housings of compression mechanisms.

In addition, in this hybrid compressor, the first compression mechanism may be driven exclusively by a drive source for driving a vehicle. Further, the second compression mechanism may be driven by an electric motor.

Alternatively, in this hybrid compressor, the two compression mechanisms need not be configured to be driven independently by the respective drive sources, and the configuration of this second embodiment of the hybrid compressor according to the present invention may allow the two compression mechanisms to be disposed along a common axis. In yet another embodiment, a hybrid compressor may be configured, such that the first compression mechanism is driven exclusively by a drive source for driving a vehicle, and the second compression mechanism is driven exclusively by an electric motor incorporated into the compressor. In this additional embodiment, a size difference is established between the diameters of each compression mechanisms and the second radial axis of the second housing of the second compression mechanism is offset relative to the first radial axis of the first housing of the first compression mechanism. Nevertheless, even if this offset configuration is not employed, as long as there is the size difference between the diameters of the compression mechanisms, the configuration of the second embodiment of the hybrid compressor according to the present invention is satisfied.

Moreover, in this second embodiment of the hybrid compressor according to the present invention, when the hybrid compressor is mounted on a vehicle, the offset direction of the second radial axis of the second housing of the second compression mechanism relative to the first radial axis of the first housing of the first compression mechanism is away from a front end of the vehicle. This offset in the direction away from the front end of the vehicle may be an offset in a horizontal direction, or may be an offset in a direction different from the horizontal direction. Further, with respect to this hybrid compressor, the first and second compression mechanisms are scroll-type compression mechanisms, and the compressor may be configured, such that the fixed scrolls of each compression mechanisms are disposed back-to-back, e.g., to extend in opposite directions from a common valve plate.

In the above-described first embodiment of the hybrid compressor according to the present invention, because the position of the second radial axis of the second housing of the second compression mechanism driven, for example, exclusively by an incorporated electric motor is offset relative to the first radial axis of the first housing of the first compression mechanism. In particular, when the compressor is mounted on a vehicle, the position of the second radial axis of the second housing of the second compression mechanism may be set relative to the first radial axis of the first housing of the first compression mechanism in a direction away from the front end of the vehicle. Because engine and other vehicle parts, such as a radiator and a fan, also may disposed in the front end of the vehicle, and although it is anticipated that the shifting parts may result in damage to the compressor when an accident occurs, if most of the external force is received by the first compression mechanism portion of the compressor, damage to the second compression mechanism portion of the compressor, in particular, damage to the electric motor, may be reduced or eliminated. Consequently, damage to the electric motor may be reduced or avoided, such that current leakage is reduced or eliminated.

Further, in the above-described second embodiment of the hybrid compressor according to the present invention, because the first diameter of the first housing of the first compression mechanism is greater than the second diameter of the second housing of the second compression mechanism, when a significant external force is applied to the compressor, most of the external force may be received by the first compression mechanism portion of the compressor, and damage to the second compression mechanism portion of the compressor, in particular, damage to the electric motor, may be reduced or eliminated. Consequently, damage to the electric motor may be reduced or avoided, such that current leakage is reduced or eliminated.

Furthermore, if the configuration of the first embodiment of the hybrid compressor and the configuration of the second embodiment of the hybrid compressor, according to the present invention, are combined; most of the external force is more likely to be received by the first compression mechanism portion of the compressor. Consequently, damage to the second compression mechanism portion of the compressor, in particular, damage to the electric motor, may be further reduced or eliminated.

Other objects, features, and advantages of the present invention will be apparent to persons of ordinary skill in the art from the following detailed description of preferred embodiments of the present invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF PREFERRED EMBODIMENTS

Figure 1:
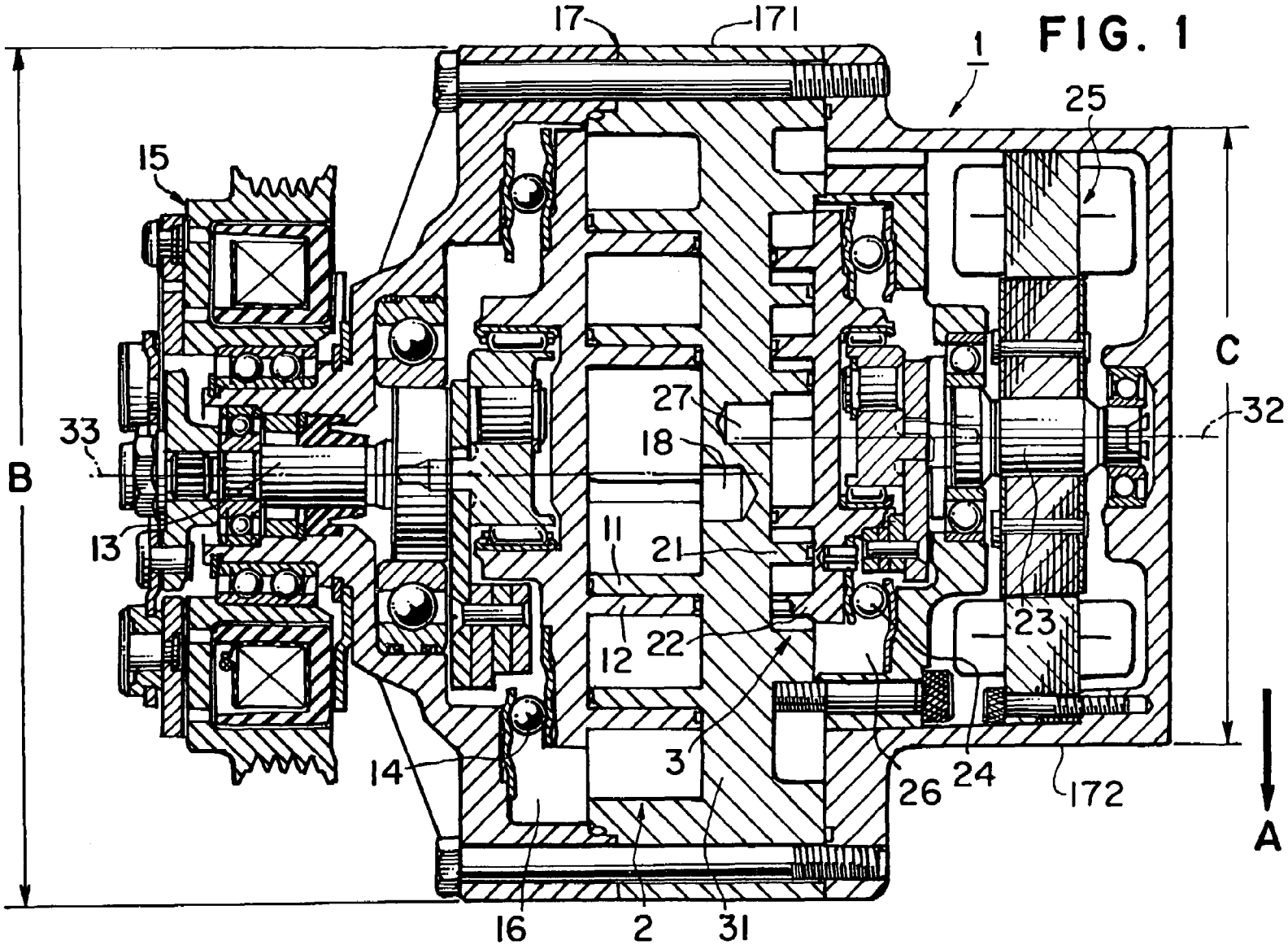
FIG. 1 is a horizontal, cross-sectional view of a hybrid compressor according to an embodiment of the present invention.
Figure 2:
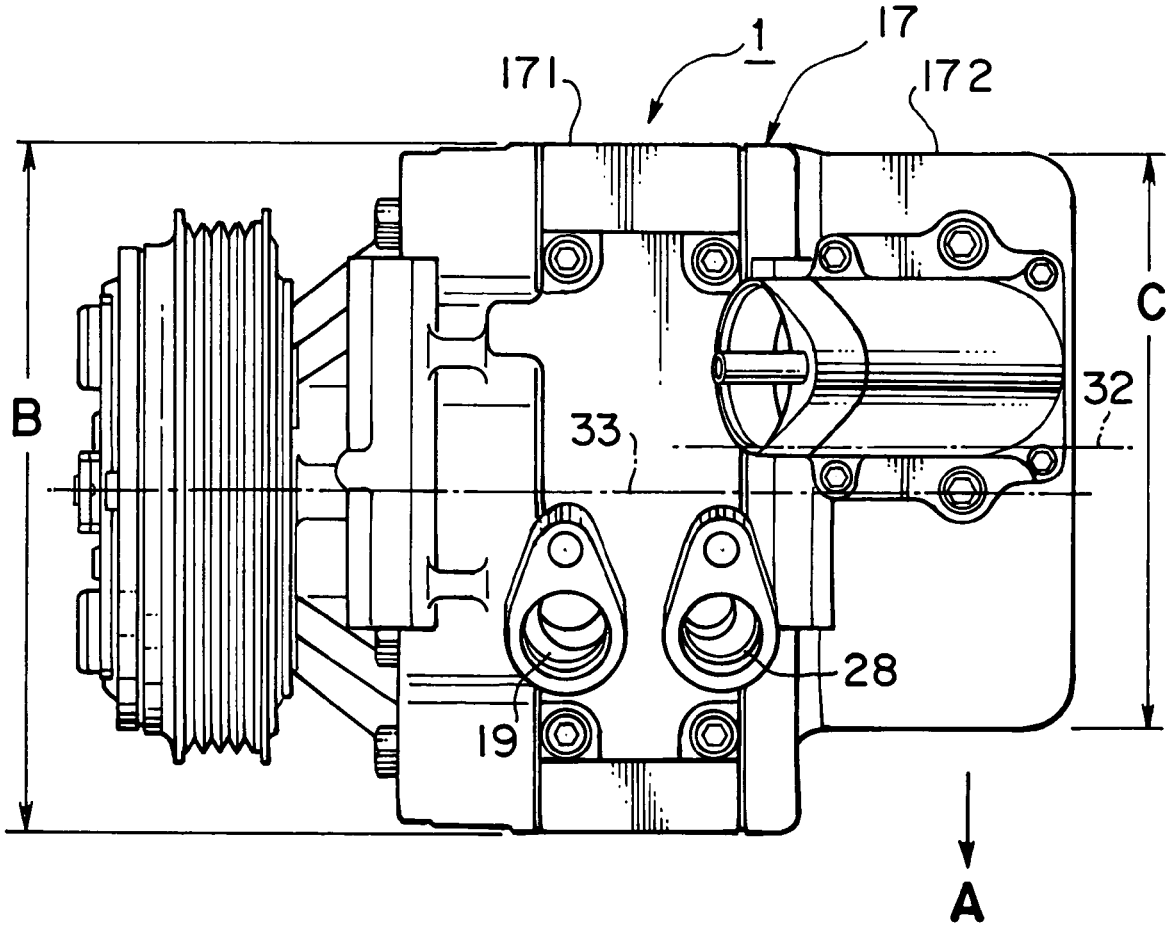
FIG. 2 is a plan view of the hybrid compressor depicted in FIG. 1, viewed as mounted in a vehicle.

FIGS. 1 and 2 depict a hybrid compressor according to an embodiment of the present invention. This embodiment is shown as a preferred embodiment, in which the aforementioned configurations of the first and second hybrid compressors according to the present invention, are both employed. This hybrid compressor is used, for example, in a refrigerant cycle of an air conditioning system mounted on a vehicle.

In FIG. 1, hybrid compressor 1 comprises a first compression mechanism 2 driven exclusively by a first drive source (not shown) via an electromagnetic clutch 15 and a second compression mechanism 3 driven exclusively by an incorporated electric motor 25 provided as a second drive source. First and second compression mechanisms 2 and 3 are disposed in the axial direction of hybrid compressor 1 and are assembled integrally with each other in the compressor. First compression mechanism 2 comprises a fixed scroll 11; an orbital scroll 12, which forms a plurality of pairs of fluid pockets for compression operation by engaging with fixed scroll 11; a drive shaft 13 for engaging and driving orbital scroll 12 to impart an orbital movement to orbital scroll 12; and ball coupling 14 for preventing the rotation of orbital scroll 12. Drive shaft 13 is rotated by the first drive source via electromagnetic clutch 15.

Second compression mechanism 3 comprises a fixed scroll 21; orbital scroll 22, which forms a plurality of pairs of fluid pockets for compression operation by engaging with fixed scroll 21; a drive shaft 23 for engaging and driving orbital scroll 22 to impart an orbital movement to orbital scroll 22; and a ball coupling 24 for preventing the rotation of orbital scroll 22. Drive shaft 23 is rotated by an incorporated electric motor 25, which is provided as the second drive source.

A suction chamber 16 is formed in first compression mechanism 2. Refrigerant is drawn into suction chamber 16 through a suction port (disposed at an orientation perpendicular to the sheet depicting FIG. 1, and depicted in FIG. 2 as suction port 19), which is provided on housing 17.

Suction chamber 26 is formed in second compression mechanism 3. Refrigerant is drawn into suction chamber 26 through a communication path with suction chamber 16 or via a suction port provided independently. The drawn refrigerant is compressed by the movement toward the center of the fluid pockets formed between the fixed and orbital scrolls of the respective compression mechanisms, the compressed refrigerant is discharged through discharge holes 18 and 27 and delivered to an external circuit through discharge port 28 (depicted in FIG. 2). In this embodiment, fixed scroll 11 of first compression mechanism 2 and fixed scroll 21 of second compression mechanism 3 are disposed back-to-back, and they are formed integrally as fixed scroll member 31.

A second radial axis 32 of a second housing 172 of second compression mechanism 3 is offset relative to a first radial axis 33 of a first housing 171 of first compression mechanism 2. This offset is preferably maximized within a range, within which the functions required to each of compression mechanisms 2 and 3 are not impaired. Hybrid compressor 1 is mounted on a vehicle, and the offset direction of second radial axis 32 of second housing 172 of second compression mechanism 3 relative to first radial axis 33 of first housing 171 of first compression mechanism 2 is away from a front part of the vehicle. In particular, direction A in FIG. 1 is toward the front part of the vehicle, and second radial axis 32 of second housing 172 of second compression mechanism 3 is offset in a direction opposite to direction A.

Further, in this embodiment, a second diameter C of second housing 172 of second compression mechanism 3 is less than a first diameter B of first housing 171 of first compression mechanism 2. Alternatively, first diameter B of first housing 171 of first compression mechanism 2 is greater than second diameter C of second housing 172 of second compression mechanism 3. As shown in FIG. 2, which is a plan view of hybrid compressor 1, second radial axis 32 of second housing 172 of second compression mechanism 3 is offset relative to first radial axis 33 of first housing 171 of first compression mechanism 2 in a direction away from the front part of the vehicle (i.e., a direction opposite to direction A), and at the same time, first diameter B of first housing 171 of first compression mechanism 2 is greater than second diameter C of second housing 172 of second compression mechanism 3.

In hybrid compressor 1, configured according to this embodiment, because second radial axis 32 of second housing 172 of second compression mechanism 3, which is driven exclusively by incorporated electric motor 25, is offset relative to first radial axis 33 of first housing 171 of first compression mechanism 2 in a direction opposite to direction A (i.e., a direction away from the front end of the vehicle), even if a significant external force is applied from the vehicle front side by, for example, an accident, most of the external force may be received by the first compression mechanism portion of compressor 1. Thus, damage to the second compression mechanism portion of compressor 1, in particular, damage to electric motor 25 may be reduced or avoided. Therefore, it becomes possible to reduce or avoid current leakage associated with damage to electric motor 25.

Further, because first diameter B of first housing 171 of first compression mechanism 2 is greater than second diameter C of second housing 172 of second compression mechanism 3, when significant external force is applied to the vehicle, most of the external force may be received by the first compression mechanism portion of compressor 1. Consequently, damage to the second compression mechanism portion of compressor 1, in particular, damage to electric motor 25 may be reduced or avoided. Therefore, it also becomes possible to reduce or avoid damage to electric motor 25 sufficient to cause current leakage.

Especially, in this embodiment, because both the configurations of setting an offset between the radical centers of the housings and setting a size difference between the diameters of each housing are employed, damage to electric motor 25 sufficient to cause current leakage may be reduced or completely avoided.

Figure 3C:
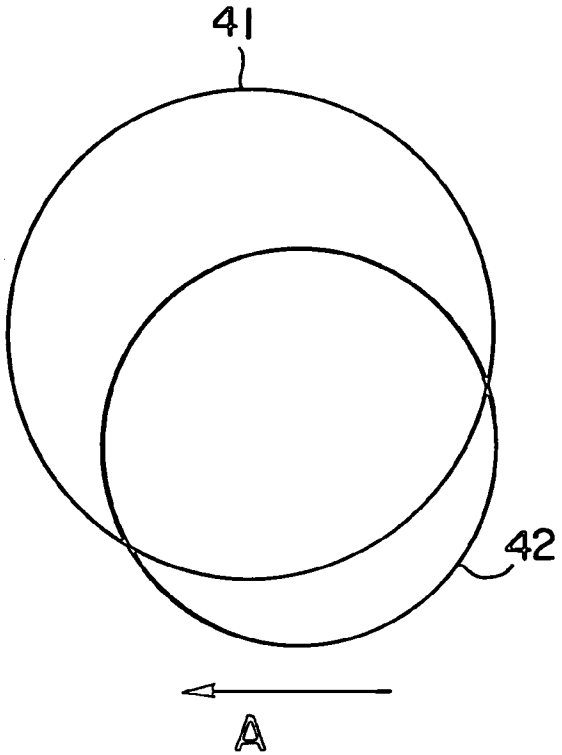
FIGS. 3A-3C are explanation views showing examples of respective offset directions of a second compression mechanism relative to a first compression mechanism.
Figure 3B:
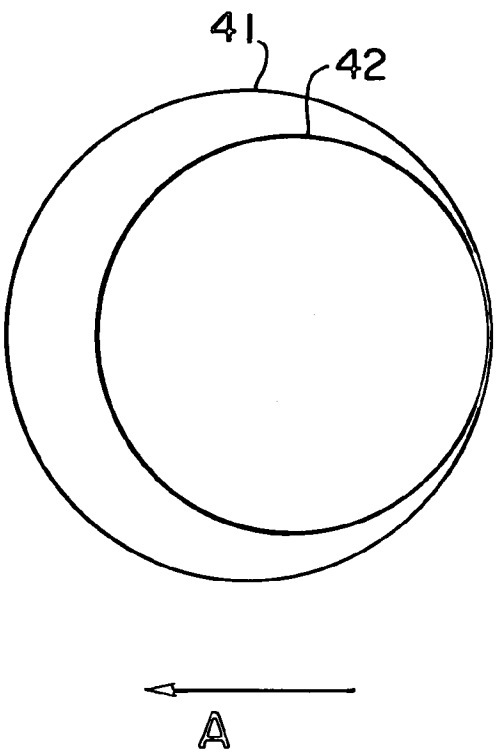
Figure 3A:
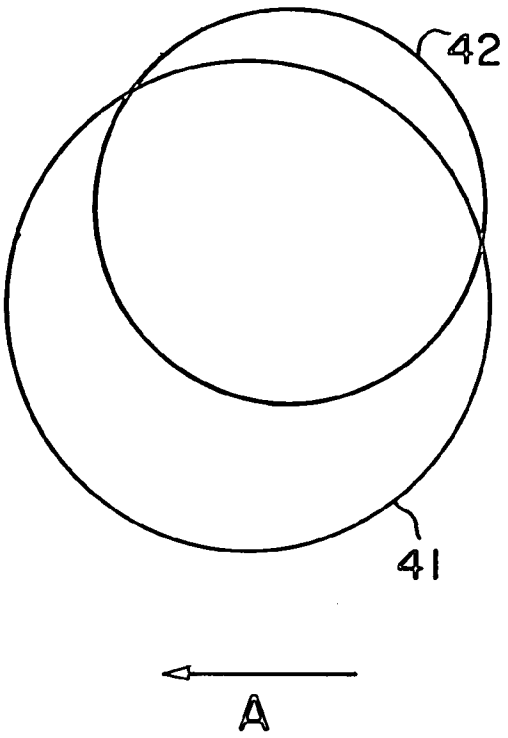

Although the offset direction of the second compression mechanism portion relative to first compression mechanism portion may be in a horizontal direction, the offset direction is not limited to the horizontal direction. The offset direction of second compression mechanism portion may be in a direction away from a front end of a vehicle. Therefore, as shown in FIGS. 3A-3C with respect to the positional relationships between a first housing circumference 41 of first compression mechanism 2 and a second housing circumference 42 of second compression mechanism 3 relative to direction A, second housing circumference 42 of second compression mechanism 3 may be offset relative to first housing shape 41 of first compression mechanism 2 in a direction toward an oblique upper side (FIG. 3A), may be offset in a horizontal direction (FIG. 3B), and may be offset in a direction toward an oblique lower side (FIG. 3C).

While the invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are considered exemplary only, with the true scope of the invention indicated by the following claims.

What is claimed is:

1. A hybrid compressor comprising:

a first compression mechanism, which is driven by a first drive source for driving a vehicle; and a second compression mechanism, which is driven by a second drive source, wherein a second radial axis of a second housing of said second compression mechanism is offset relative to a first radial axis of a first housing of said first compression mechanism, and said hybrid compressor is mounted on said vehicle, wherein an offset direction of said second radial axis of said second housing of said second compression mechanism relative to said first radial axis of said first housing of said first compression mechanism is away from a front end of said vehicle.

2. The hybrid compressor of claim 1, wherein said first compression mechanism is driven exclusively by said drive source for driving said vehicle.

3. The hybrid compressor of claim 1, wherein said second compression mechanism is driven by an electric motor.

4. The hybrid compressor of claim 1, wherein said offset direction of said second radial axis of said second housing of said second compression mechanism from said first radial axis of said first housing of said first compression mechanism is in a horizontal direction away from said front end of said vehicle.

5. The hybrid compressor of claim 1, wherein said offset direction of said second radial axis of said second housing of said second compression mechanism from said first radial axis of said first housing of said first compression mechanism is in a direction different from a horizontal direction and away from said front end of said vehicle.

6. The hybrid compressor of claim 1, wherein each of said first and second compression mechanisms is a scroll-type compression mechanisms comprising a fixed scroll, and said fixed scrolls of each of said compression mechanisms are disposed to extend in opposite directions from a common valve plate.

7. A hybrid compressor comprising:

a first compression mechanism, which is driven by a first drive source for driving a vehicle; and a second compression mechanism, which is driven by a second drive source, wherein a second diameter of a second housing of said second compression mechanism is less than a first diameter of a first housing of said first compression mechanism, and said hybrid compressor is mounted on said vehicle, wherein an offset direction of said second radial axis of said second housing of said second compression mechanism relative to said first radial axis of said first housing of said first compression mechanism is away from a front end of said vehicle.

8. The hybrid compressor of claim 7, wherein said first compression mechanism is driven exclusively by said drive source for driving said vehicle.

9. The hybrid compressor of claim 7, wherein said second compression mechanism is driven by an electric motor.

10. The hybrid compressor of claim 7, wherein said first compression mechanism is driven exclusively by said drive source for driving said vehicle, and said second compression mechanism is driven exclusively by an electric motor incorporated into said compressor.

11. The hybrid compressor of claim 7, wherein a second radial axis of said second housing of said second compression mechanism is offset relative to a first radial axis of said first housing of said first compression mechanism.

12. The hybrid compressor of claim 7, wherein said offset direction of said second radial axis of said second housing of said second compression mechanism from said first radial axis of said first housing of said first compression mechanism is in a horizontal direction away from said front end of said vehicle.

13. The hybrid compressor of claim 7, wherein said offset direction of said second radial axis of said second housing of said second compression mechanism from said first radial axis of said first housing of said first compression mechanism is in a direction different from a horizontal direction and away from said front end of said vehicle.

14. The hybrid compressor of claim 7, wherein each of said first and second compression mechanisms is a scroll-type compression mechanisms comprising a fixed scroll, and said fixed scroll of each of said compression mechanisms are disposed to extend in opposite directions from a common valve plate.

15. A vehicle comprising a hybrid compressor, wherein said hybrid compressor comprises:

a first compression mechanism, which is driven by a first drive source for driving the vehicle; and a second compression mechanism, which is driven by a second drive source, wherein a second radial axis of a second housing of said second compression mechanism is offset relative to a first radial axis of a first housing of said first compression mechanism, and said hybrid compressor is mounted on said vehicle, wherein an offset direction of said second radial axis of said second housing of said second compression mechanism relative to said first radial axis of said first housing of said first compression mechanism is away from a front end of said vehicle.

16. A vehicle comprising a hybrid compressor, wherein said hybrid compressor comprises:

a first compression mechanism, which is driven by a first drive source for driving a vehicle; and a second compression mechanism, which is driven by a second drive source, wherein a second diameter of a second housing of said second compression mechanism is less than a first diameter of a first housing of said first compression mechanism, and said hybrid compressor is mounted on said vehicle, wherein an offset direction of said second radial axis of said second housing of said second compression mechanism relative to said first radial axis of said first housing of said first compression mechanism is away from a front end of said vehicle.

* * * * *